US007465186B2

(12) United States Patent
Yotsutani

(10) Patent No.: US 7,465,186 B2
(45) Date of Patent: Dec. 16, 2008

(54) ELECTRIC CONNECTOR

(75) Inventor: Kenichi Yotsutani, Tokyo (JP)

(73) Assignee: I-Pex Co. Ltd., Tokyo (JP)

( * ) Notice: Subject to any disclaimer, the term of this patent is extended or adjusted under 35 U.S.C. 154(b) by 0 days.

(21) Appl. No.: 11/820,109

(22) Filed: Jun. 18, 2007

(65) Prior Publication Data

US 2008/0003855 A1 Jan. 3, 2008

(30) Foreign Application Priority Data

Jul. 3, 2006 (JP) ..... 2006-183209

(51) Int. Cl.
*H01R 12/24* (2006.01)

(52) U.S. Cl. ..... 439/497

(58) Field of Classification Search ..... 439/579, 439/581, 491, 607
See application file for complete search history.

(56) References Cited

U.S. PATENT DOCUMENTS

2006/0035526 A1* 2/2006 Shimizu ..... 439/660
2006/0252310 A1* 11/2006 Yamada et al. ..... 439/579

FOREIGN PATENT DOCUMENTS

JP 2002-280102 9/2002
JP 2005-302417 10/2005

* cited by examiner

*Primary Examiner*—Phuong K Dinh
(74) *Attorney, Agent, or Firm*—Reed Smith LLP

(57) ABSTRACT

Such a configuration is achieved that shell connecting portion which is a contact portion of conductive shells of first and second connectors fitted to each other in a direction approximately perpendicular to multipolar arrangement is disposed opposite to a terminal connecting portion which is a contact portion of conductive terminals, so that contact pressure at the shell connecting portion is caused to function on the terminal connecting portion to improve electric contact performance of the terminal connecting portion, and the conductive shells are disposed approximately along the conductive terminals to improve a function for shielding electromagnetic waves generated based upon electric signals flowing in the conductive terminals. By adopting such a configuration, even if an electric connector is lowered in height and downsized, contact reliability of the conductive terminals is maintained well, so that improvement of properties of electromagnetic interference (EMI) and electrostatic discharge (ESD) can be achieved.

5 Claims, 8 Drawing Sheets

ELECTRIC CONNECTOR

BACKGROUND OF THE INVENTION

1. Field of the Invention

The present invention relates to an electric connector configured such that first and second connectors are fitted to each other in a direction approximately perpendicular to a multipolar arrangement direction of conductive terminals (contacts).

2. Description of the Related Art

Generally, in various electric apparatuses, it has been widely performed to connect a plurality of coaxial cables, a flexible circuit board, or the like to a printed circuit board via a pair of electric connectors configured to allow fitting connection to each other. As the pair of electric connectors, for example, a receptacle connector (first connector) mounted on a printed circuit board and a plug connector (second connector) fitted to the receptacle connector are used. In a state in which end portions of a plurality of coaxial cables, an end portion of a flexible circuit board, or the like are joined to the plug connector, the plug connector is fitted in the receptacle connector.

Regarding the pair of electric connectors thus configured to allow mutual fitting, for example, as disclosed in JP-A-2002-280102, there has been conventionally known a vertically-fitting type electric connector in which the above-described plug connector is plugged and fitted in a direction approximately perpendicular to a multipolar arrangement direction of conductive terminals (contacts), namely, in a direction approximately perpendicular to a plane of the printed circuit board mounted with the receptacle connector.

However, also in such a vertically-fitting type electric connector, lowering in height and downsizing have been rapidly promoted as in the case of another electric connector, since space allowing displacement of conductive terminals at a fitting time is reduced so that contact pressure of the conductive terminals is lowered, which may result in a problem in contact reliability which is the most fundamental performance required for an electric connector.

Further, in a recent electric connector, for the purpose of preventing malfunction of an apparatus due to noise according to increase in speed of an electric signal, reducing influence of electromagnetic waves on the human body, and the like, improvement of properties of electromagnetic interference (EMI) and electrostatic discharge (ESD) is an urgent need. However, in a general electric connector, for example, as disclosed in JP-A-2005-302417, since a conductive shell covering an insulating housing has no arrangement relationship with conductive terminals, sufficient properties of electromagnetic interference (EMI) and electrostatic discharge (ESD) cannot be obtained in the present circumstances.

Therefore, an object of the present invention is to provide an electric connector which can maintain contact reliability of conductive terminals well and simultaneously can achieve improvement of properties of electromagnetic interference (EMI) and electrostatic discharge (ESD) even if being lowered in height and downsized.

SUMMARY OF THE INVENTION

In order to achieve the above object, an electric connector according to the present invention includes a first connector and a second connector each of which is provided with a plurality of conductive terminals arranged at suitable pitch distances in a multipolar manner along a longitudinal widthwise direction of a slender flat plate-like insulating housing and a conductive shell covering an outer surface of the insulating housing, where the first and second connectors are fitted to each other in a direction approximately perpendicular to a direction of the multipolar arrangement so that the conductive terminals of the first and second connectors and the conductive shells thereof are brought in contact with each other, respectively, to form a terminal connecting portion CS and a shell connecting portion SS, wherein the shell connecting portion SS is disposed opposite to the terminal connecting portion CS through the insulating housing of the second connector in a direction perpendicular to a fitting direction of the first and second connectors.

According to the electric connector having such a configuration, since the shell connecting portion SS disposed opposite to the terminal connecting portion CS of the first and second connector functions to maintain contact pressure at the terminal connecting portion CS well, electric contact performance of the terminal connecting portion CS is improved.

Further, since the shell connecting portion is disposed opposite to the terminal connecting portion CS, a shield wire formed by the conductive shells of both the connectors is formed continuously, and it further becomes possible to dispose the shield wire along an electric signal wire formed by the conductive terminals of both the connectors, so that electromagnetic waves generated by the electric signal wire can be shielded well.

As described above, according to the electric connector according to the present invention, even if an electric connector is lowered in height and downsized, contact reliability of conductive terminals can be maintained well, and simultaneously improvement of properties of electromagnetic interference (EMI) and electrostatic discharge (ESD) can be achieved, so that reliability of the electric connector can be improved at low cost.

DETAILED DESCRIPTION OF EMBODIMENTS

Hereinafter, an embodiment of the present invention applied to an electric connector which connects a plurality of coaxial cables to a printed circuit board will be explained in detail with reference to the drawings.

Figure 1:
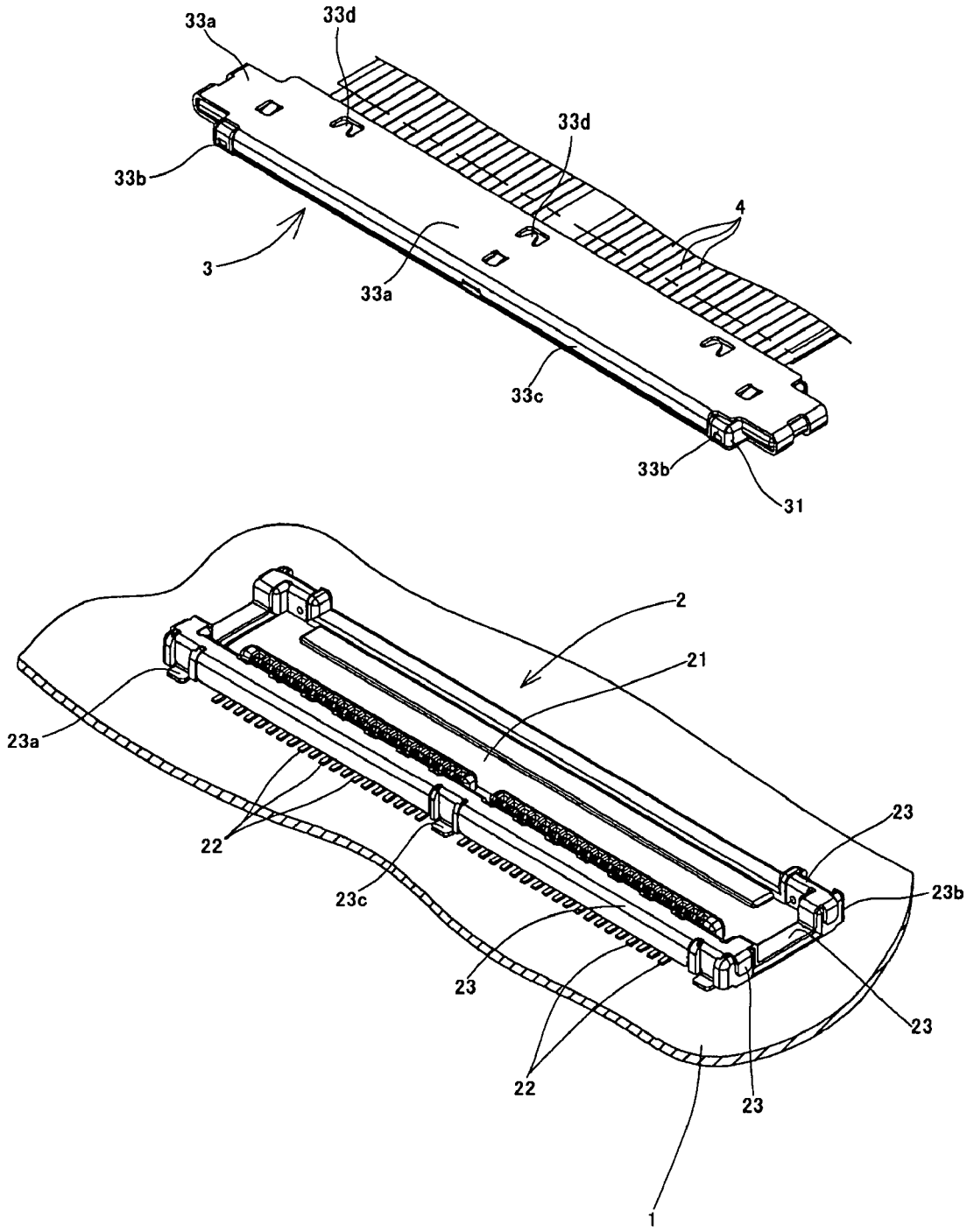
FIG. 1 is an appearance perspective explanatory view showing a state of an electric connector for coaxial cables according to an embodiment of the present invention just before fitting thereof.
Figure 2:
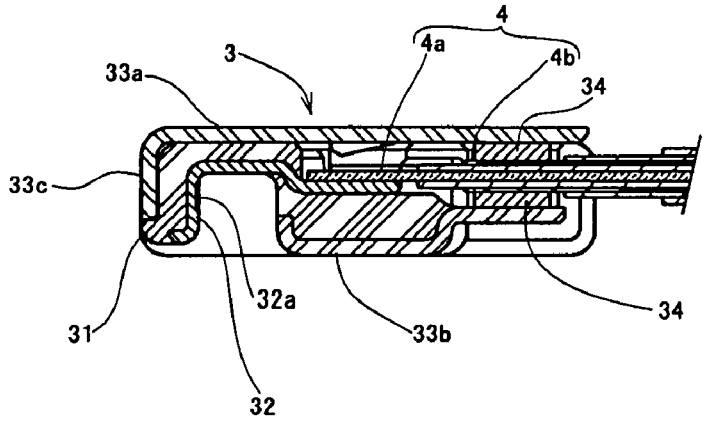
FIG. 2 is a cross sectional explanatory view showing a structure of a plug connector used in FIG. 1.
Figure 3:
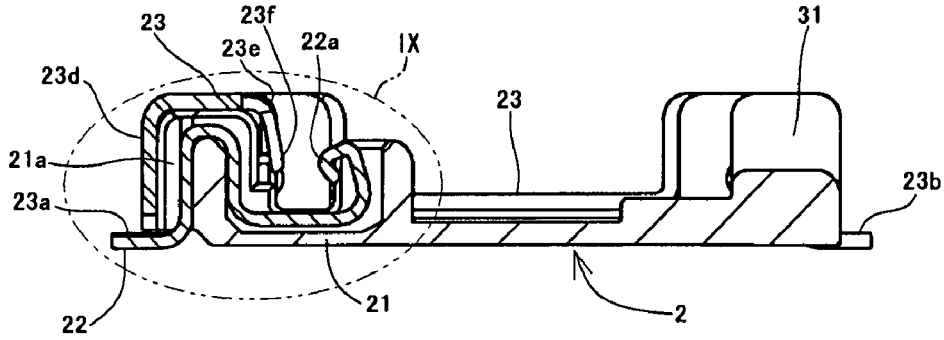
FIG. 3 is a cross sectional explanatory view showing a structure of a receptacle connector used in FIG. 1.
Figure 4:
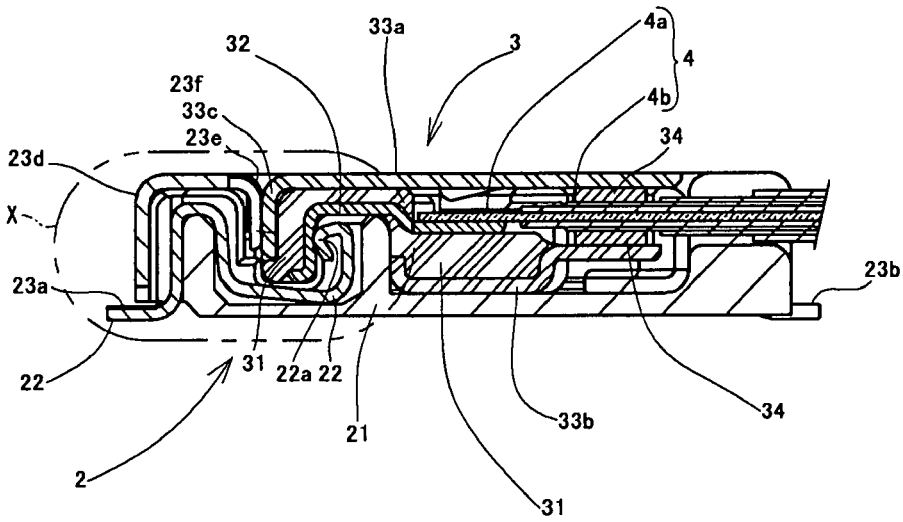
FIG. 4 is a cross sectional explanatory view of a state in which the connectors shown in FIG. 1 have been fitted to each other.
Figure 5:
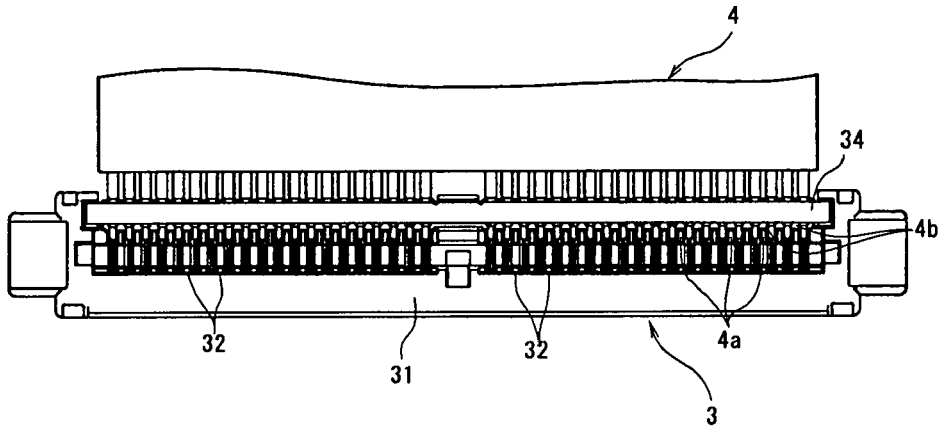
FIG. 5 is a plan explanatory view showing a state of the plug connector used in FIG. 1 just after being soldered and connected with coaxial cables and just before mounted with an upper conductive shell.
Figure 6:
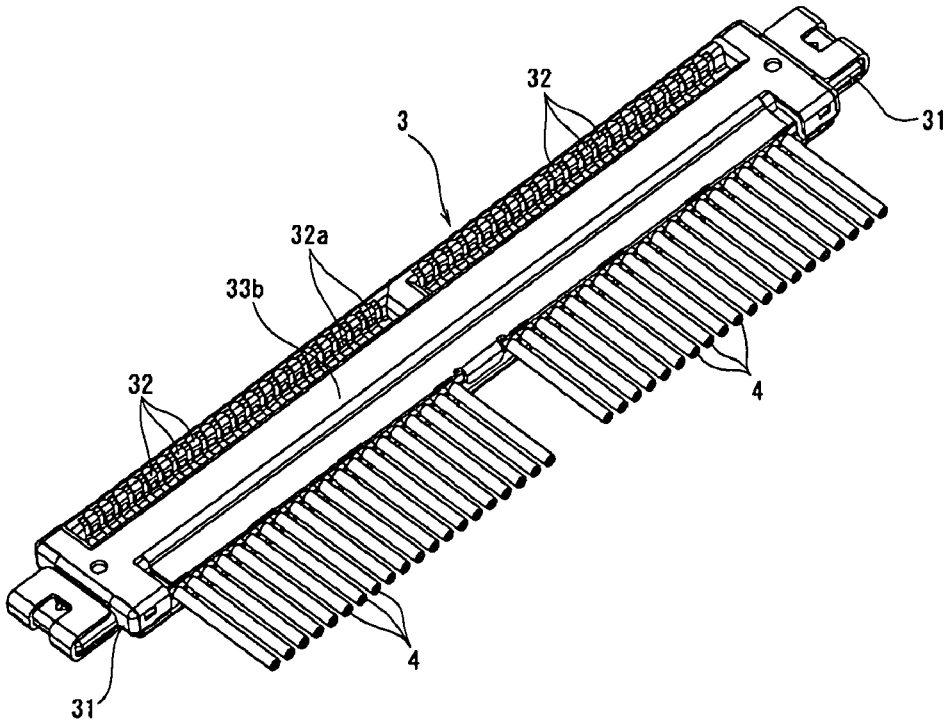
FIG. 6 is an appearance perspective explanatory view showing a bottom face structure of the plug connector used in FIG. 1.
Figure 7:
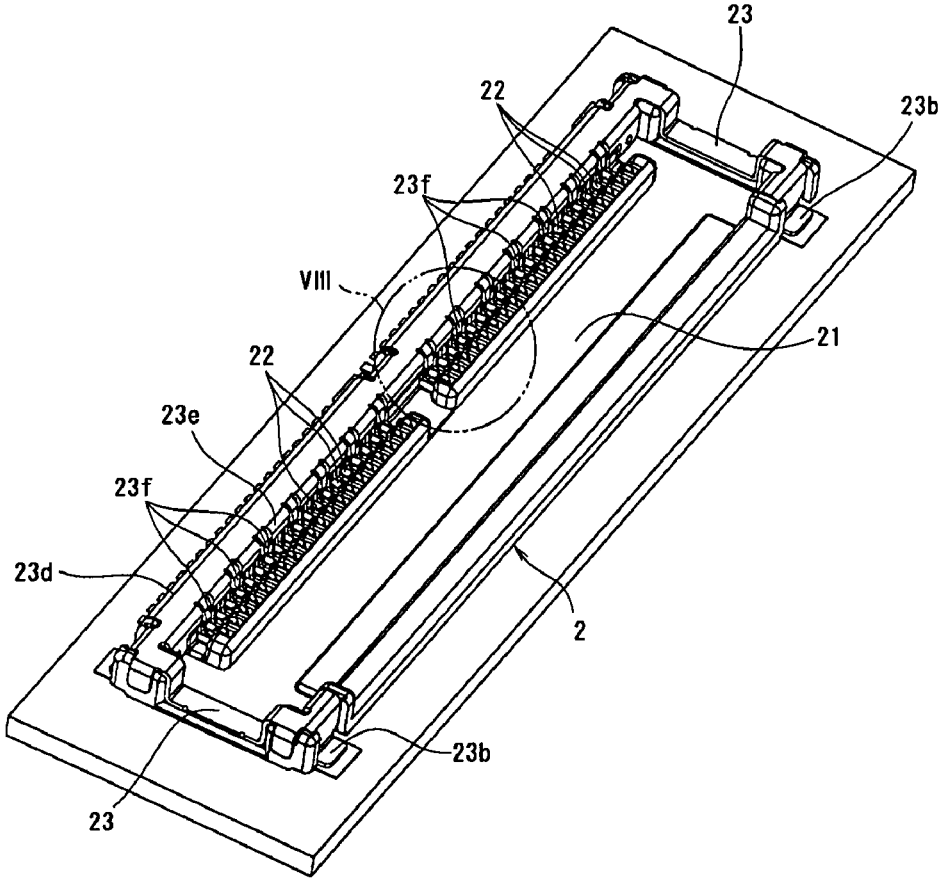
FIG. 7 is an appearance perspective explanatory view showing a top face structure of the receptacle connector used in FIG. 1.

First, an electric connector shown in FIG. 1 includes a receptacle connector (first connector) 2 mounted on a printed circuit board 1 and a plug connector (second connector) 3 fitted to the receptacle connector 2. That is, an electric connector according to the present invention has a vertically-fitting type configuration in which the plug connector 3 which is disposed just above the receptacle connector 2 is brought down in FIG. 1 in a direction approximately perpendicular to the printed circuit board 1 to plug a fitting portion of the plug connector 3 into a fitting portion of the receptacle connector 2 so that both the connectors are fitted to each other.

Hereinafter, a direction in which the plug connector 3 is plugged is downward, and an opposite direction in which the plug connector 3 is unplugged is upward.

As shown in FIGS. 2 to 7, the receptacle connector (first connector) 2 and the plug connector (second connector) 3 include insulting housings 21 and 31 extending to be formed of a slender plate, respectively. A plurality of conductive terminals (contacts) 22 and 32 are arranged at suitable pitch intervals in a multipolar manner along longitudinal directions of the slender insulating housings 21 and 31. Further, an approximately entire outer surface of the insulating housing 31 of the plug connector 3 is covered with a metal conductive shell 33, and an outer peripheral portion of the receptacle connector 2 is covered with a metal conductive shell 23. One of edge portions of the plug connector 3 in a longitudinal direction thereof is joined with terminal portions of a plurality of coaxial cables 4 arranged in parallel in a multipolar manner.

Hereinafter, the end edge portion on the rear side joined with the end portions of the coaxial cables 4 is called "rear end edge portion", and the other end edge portion on the front side opposite to the rear end edge portion is called "front end edge portion", and besides end edge portions of the receptacle connector 2 corresponding to the rear end edge portion and the front end edge portion of the plug connector 3 are similarly called "rear end edge portion" and "front end edge portion", respectively.

Covering material of the end portions of the coaxial cables 4 are removed to expose cable central conductors (signal wires) 4*a* and cable outer conductors (shield wires) 4*b*. The cable central conductors 4*a* each of which is disposed along the center of axis are collectively soldered and connected by using, for example, a bar-like solder to the conductive terminals (contacts) 32 of the plug connector 3 described above, respectively. Further, the cable outer conductors 4*b* each of which is disposed to surround an outer periphery of the cable central conductor 4*a* are soldered and connected in a state of being sandwiched and supported from above and below by ground bars 34 and 34 disposed vertically in pair to be retained. Incidentally, the coaxial cables 4 and the conductive terminals (contacts) 32 of the plug connector 3 can be connected to each other by crimping connection, insulation displacement connection, or the like.

The above-described conductive shell 33 of the plug connector (second connector) 3 includes an upper conductive shell 33*a* and a lower conductive shell 33*b* that form the upper face and the lower face in FIG. 1, respectively. Further, the lower conductive shell 33*b* of these shells is subjected to insert molding to be exposed on a bottom face (lower face in FIG. 1) of the above-described insulating housing 31.

Further, the upper conductive shell 33*a* is slid from the front end edge portion to be fitted to the upper face side of the insulating housing 31 in a state after the above-described soldering connection of the coaxial cables 4 (in particular see FIG. 5), and fixed to cover the upper face side of the insulating housing 31 almost entirely. At that time, the front end edge portion of the upper conductive shell 33*a* forms a bent outer end piece 33*c* bent downward at an approximately right angle, so that the front end face of the insulating housing 31 is covered with the bent outer end piece 33*c* from outside.

Further, a plurality (three) of plate-spring-like elastic connecting tongue pieces 33*d* on the upper side is formed on the rear end edge portion of the upper conductive shell 33*a* at suitable intervals along its longitudinal direction. Each of the elastic connecting tongue pieces 33*d* is formed in a notched manner like a cantilever, and distal end portions (rear end portions) of the elastic connecting tongue pieces 33*d* are brought in pressure contact with the upper surface of the above-described upper ground bar 34 from above.

In this manner, in the plug connector 3 serving as the second connector, the upper face (plane), lower face (bottom face), front face and both side faces of the insulating housing 31, namely, an approximately entire face of the insulating housing 31 is covered with the conductive shell 33. This is a preferable structure in obtaining electromagnetic shielding effect, but it is not necessarily needed to have a structure in which the conductive shell 33 covers the entire of the insulating housing 31.

On the other hand, the above-described conductive shell 23 provided on the receptacle connector 2 serving as the first connector is disposed to surround a portion of the insulating housing 21 extending from the front end edge portion thereof to both end edge portions in a longitudinal direction thereof. Holddowns 23*a* and 23*b* bent to project forward and backward are formed on both end portions of the conductive shell 23 in a longitudinal direction thereof, respectively. A holddown 23*c* to project forward is also formed on an approximately central portion of the front end edge portion of the conductive shell 23 in the longitudinal direction. The holddowns 23*a*, 23*b*, and 23*c* are soldered and joined to a ground electrically-conducting path (not shown) on the printed circuit board 1 to perform electrical connection and fixation of the entire receptacle connector 2.

Further, front end edge side portions of the conductive terminals (contacts) 22 provided on the receptacle connector (first connector) 2 are formed to project forward from the front end edge portion of the insulating housing 21, and the forwardly projecting portions are each soldered and joined to a signal electrically-conductive path (not shown) on the printed circuit board 1 to perform electrical connection.

Figure 8:
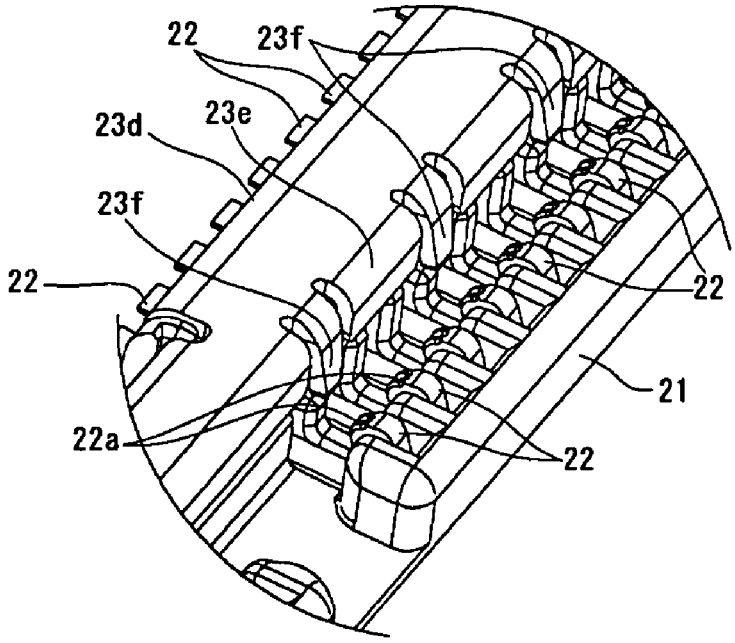
FIG. 8 is an appearance perspective explanatory view showing a VIII portion of the receptacle connector shown in FIG. 7 in an enlarged manner.
Figure 9:
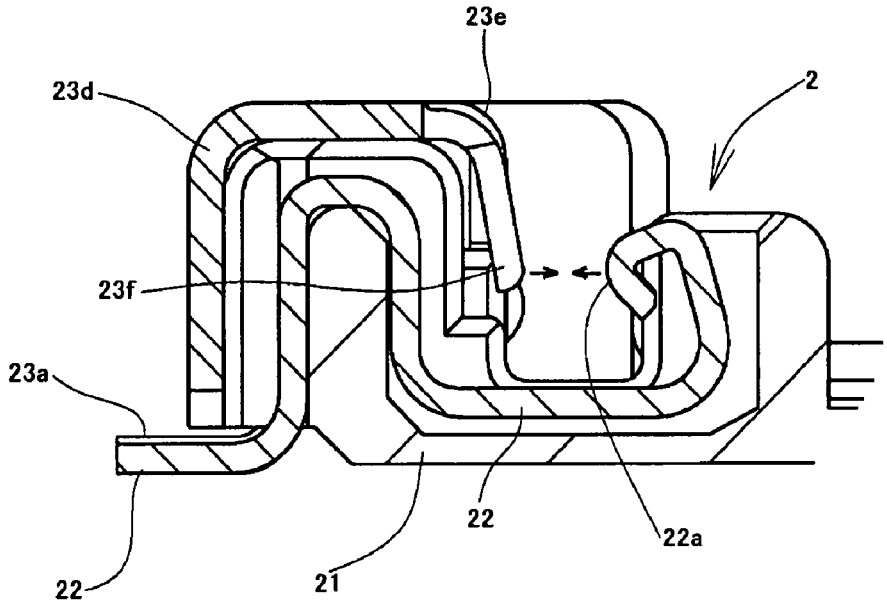
FIG. 9 is a cross sectional explanatory view showing a IX portion of the receptacle connector shown in FIG. 3 in an enlarged manner.

Further, the above-described front end edge portion 23*d* of the conductive shell 23 of the receptacle connector (first connector) 2 is formed into an approximately L shape in cross section to cover, from above, a convex portion 21*a* formed to extend like a standing wall in a longitudinal direction at the front end edge portion of the insulating housing 21. That is, as shown in FIG. 8 and FIG. 9 in particular, the front end edge portion 23*d* of the conductive shell 23 is erected to cover the front end face of the above-described convex portion 21*a* of the insulating housing 21, bent at an approximately right angle from an upper end position of the front end edge portion 23*d* in the erecting direction to extend rearward along the upper face of the insulating housing 21, and then bent downward at an approximately right angle to form an inner end edge portion 23*e* extending downward.

The inner end edge portion 23*e* extending downward is formed in a longitudinal member extending along a longitudinal direction of the receptacle connector 2, and a plurality of elastic connecting tongue pieces 23*f* is disposed in an intermediate position in a longitudinal direction of the inner end edge portion 23*e* at suitable intervals along the longitudinal direction. Each of the elastic connecting tongue pieces 23*f* is formed in a notching manner like a cantilever so that it has suitable elasticity. A lower end portion of each of the elastic connecting tongue pieces 23*f* is provided to extend obliquely rearward, and the portion extending obliquely rearward comes in pressure contact with the above-described bent outer end piece 33*c* provided on the front end side of the plug connector 3.

Figure 10:
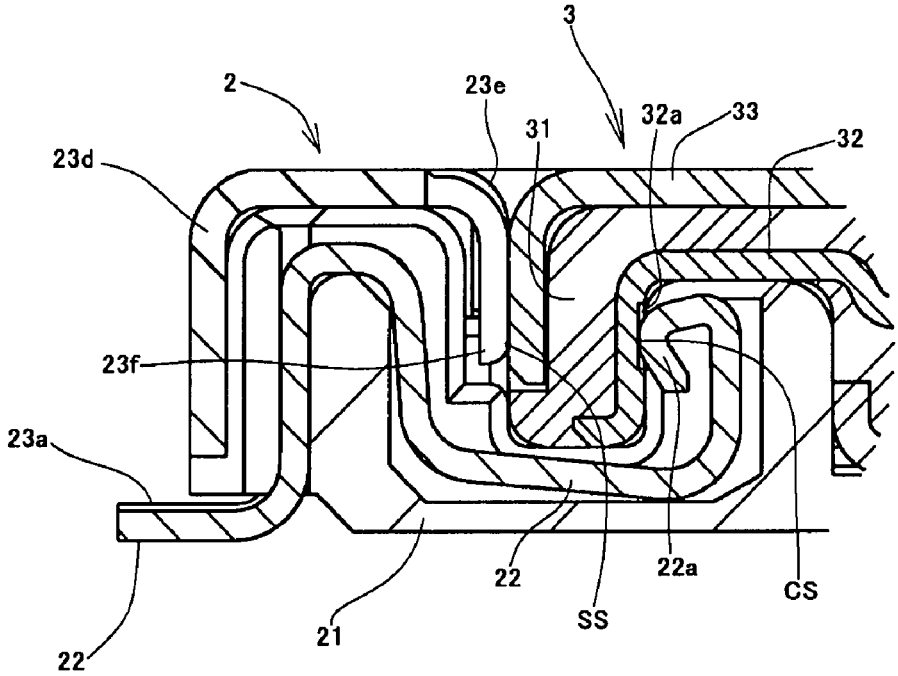
FIG. 10 is a cross sectional explanatory view showing an X portion shown in FIG. 4 in a state in which both the connectors are fitted to each other in an enlarge manner.

That is, as described above, the plug connector 3 serving as the second connector is plugged downward (in a direction approximately perpendicular to a multipolar arrangement direction of the coaxial cable 4) and fitted to the receptacle connector 2 serving as the first connector, and when both the connectors 2 and 3 are fitted to each other, as shown in FIG. 10 in particular, the conductive terminals (contacts) 22 and 32 provided on both the connectors 2 and 3 respectively are brought in contact with each other to form terminal connecting portions CS at the contact portions, and simultaneously, the bent outer end piece 33*c* provided on the upper conductive shell 23 of the plug connector 3 comes in pressure contact with each of the elastic connecting tongue piece 23*f* of the conductive shell 23 provided on the receptacle connector 2 to form shell connecting portions SS at the contact potions.

At this time, in the above-described terminal connecting portion CS, a bent projecting portion 22*a* of the conductive terminal 22 of the receptacle connector 2 is brought in pressure contact with a concave groove portion 32*a* provided on the conductive terminal 32 of the plug connector 3 in an undulated manner. As a result, an electric signal supplied via the above-described cable central conductor (signal wire) 4*a* of the coaxial cable 4 is sent to the front end of the plug connector 3 via each conductive terminal (contact) 32 of the plug connector 3, and then transmitted to each conductive terminal (contact) 22 of the receptacle connector 2 via the terminal connecting portion CS, so that the electric signal flows in an approximately S shape corresponding to a bent shape of the conductive terminal 22 to be supplied to the printed circuit board 1.

The cable outer conductor (shield wire) 4*b* of the coaxial cable 4 is electrically connected by bring the upper and lower ground bars 34 and 34 in pressure contact with the elastic connecting tongue piece 33*d* positioned on the upper side of the upper conductive shell 33*a* and the lower conductive shell 33*b* of the plug connector 3. The bent outer end piece 33*c* provided on the front end side of the upper conductive shell 33*a* is connected to the conductive shell 23 of the receptacle connector 2 via the above-described shell connecting portion SS, so that a shield wire along a signal wire for the electric signal is formed.

That is, the above-described terminal connecting portion CS and shell connecting portion SS are disposed at about the same level in height in a height direction from the printed circuit board 1, and the shell connecting portion SS is disposed opposite to the terminal connecting portion CS in an anteroposterior direction (in a direction perpendicular to a fitting direction of both the connectors 2 and 3). The insulating housing 31 of the plug connector 3 is interposed between the shell connecting portion SS and the terminal connecting portion CS. By pressing forces opposite to each other in an anteroposterior direction generated between the shell connecting portion SS and the terminal connecting portion CS through the insulating housing 31 interposed therebetween by the elastic connecting tongue piece 23*f* positioned on the front end side of the conductive shell 23 and the bent projecting portion 22*a* of the conductive terminal 22 (see arrow in FIG. 9), a contact state in particular in the terminal connecting portion CS is retained well.

Further, as described above, since the shell connecting portion SS is disposed opposite to the terminal connecting portion CS in an anteroposterior direction, the shield wire formed by both the conductive shells 23 and 33 of both the connectors 2 and 3 is continuously formed. At this time, the shell connecting portions SS forming the shield wire is disposed at a position near the terminal connecting portion CS disposed in the deep portion inside the connector. Therefore, the shield wire is formed along the above-described electric signal wire formed in an approximately-S shape by the conductive terminals 22 and 23 of both the connectors 2 and 3. As a result, shielding of electromagnetic waves generated by the electric signal wire is performed well.

As described above, according to the embodiment, since the shell connecting portion SS is disposed opposite to the terminal connecting portion CS formed when the receptacle connector 2 as the first connector and the plug connector 3 as the second connector fit each other, the pressing force at the shell connecting portion SS functions to maintain contact pressure at the terminal connecting portion CS well, as a result, electric contact performance of the terminal connecting portion CS is improved.

Further, since the shell connecting portion SS is disposed at a position related to the vicinity of the position of the terminal connecting portion CS, the conductive shells 23 and 33 are disposed approximately along the electric signal wire passing through the conductive terminals 22 and 32, thereby a shielding function of the conductive shells 23 and 33 to electromagnetic waves generated from the electric signal wire is performed well.

Though the present invention made by the present inventor (s) has been explained above based upon the embodiment, it is obvious that the present invention is not limited to the above-described embodiment and can be variously modified without departing from the scope of the present invention.

For example, in the above-described embodiment, a portion constituting the shell connecting portion SS in the conductive shell 23 of the receptacle connector (first connector) 2 is elastically displaceable or deformable, but it is possible to adopt a configuration that a portion constituting the shell connecting portion SS of the plug connector (second connector) 3 or both the portions are elastically displaceable or deformable.

Further, the present invention is not limited to a connector for coaxial cables such as the above-described embodiment and can be similarly applied to an electric connector of a type that a plurality of coaxial cables and a plurality of insulating cables are mixed, an electric connector to which a flexible circuit board or the like is joined, and the like.

Further, the present invention can be variously modified to have a structure in which the conductive shell of the plug connector does not include the upper conductive shell and the lower conductive shell as described above, but is integrally formed instead, a structure that the conductive shell is divided into three or more, and the like.

As described above, the present invention can be widely applied to various electric connectors used in various electric apparatuses.

What is claimed is:

1. An electric connector comprising:

a first connector and a second connector each of which is provided with a plurality of conductive terminals arranged at suitable pitch intervals in a multipolar manner along a longitudinal widthwise direction of a slender flat plate-like insulating housing and a conductive shell covering an outer surface of the insulating housing, wherein the first and second connectors are a receptacle connector mounted on a printed circuit board and a plug connector fitted in the receptacle connector, respectively, which are fitted to each other in a direction approximately perpendicular to a direction of the multipolar arrangement in such a manner that the plug connector is plugged and fitted in a direction approximately perpendicular to a plane of the printed circuit board mounted with the receptacle connector so that the conductive terminals of the receptacle and plug connectors and the conductive shells are brought in contact with each other, respectively, to form a terminal connecting portion CS and a shell connecting portion SS, and wherein the shell connecting portion SS is disposed opposite to the terminal connecting portion CS through the insulating housing of the plug connector in a direction perpendicular to a fitting direction of the receptacle and plug connectors.

2. The electric connector according to claim 1, wherein a portion constituting the shell connecting portion SS of the conductive shell is configured in an elastically displaceable manner so as to press the shell connecting portion SS toward the terminal connecting portions CS.

3. The electric connector according to claim 1, wherein a portion constituting the shell connecting portion 55 of the conductive shell is provided with a plurality of elastically displaceable elastic connecting tongue pieces arranged at suitable intervals along the direction of the multipolar arrangement.

4. The electric connector according to claim 1, wherein the terminal connecting portion CS and the shell connecting portion SS are disposed at about the same level in height in a height direction from a printed circuit board.

5. The electric connector according claim 1, wherein the conductive shell of the plug connector covers an approximately entire outer surface of the insulating housing.

* * * * *